United States Patent [19]

Mason et al.

[11] Patent Number: 4,555,974

[45] Date of Patent: Dec. 3, 1985

[54] SERVO ACTUATOR CONTROL/DAMPING MECHANISM AND METHOD

[75] Inventors: James S. Mason, Marcellus; David Foerster, Paw Paw, both of Mich.

[73] Assignee: Pneumo Corporation, Boston, Mass.

[21] Appl. No.: 726,920

[22] Filed: Apr. 24, 1985

Related U.S. Application Data

[63] Continuation of Ser. No. 529,115, Sep. 2, 1983, abandoned.

[51] Int. Cl.[4] ..... F15B 9/09

[52] U.S. Cl. ..... 91/363 A; 91/509; 91/464; 91/459; 91/436

[58] Field of Search ..... 91/510, 509, 437, 464, 91/365, 363 A, 436, 459; 251/131

[56] References Cited

U.S. PATENT DOCUMENTS

| | | | |
|---|---|---|---|
| 2,970,443 | 2/1961 | Springham | 91/437 |
| 3,095,784 | 7/1963 | Colhoun | 91/363 A |
| 3,477,347 | 11/1969 | Rice | 91/437 |
| 3,561,322 | 2/1971 | Gerstine | 91/510 |
| 4,128,047 | 12/1978 | Caero | 91/437 |
| 4,154,262 | 5/1979 | Blume et al. | 91/464 |
| 4,192,218 | 3/1980 | Yamamoto | 91/436 |
| 4,235,153 | 11/1980 | Rinde et al. | 91/363 A |
| 4,445,421 | 5/1984 | Walker et al. | 91/363 A |

FOREIGN PATENT DOCUMENTS

| | | | |
|---|---|---|---|
| 1421593 | 1/1976 | United Kingdom | 91/436 |

*Primary Examiner*—Robert E. Garrett
*Assistant Examiner*—Richard S. Meyer
*Attorney, Agent, or Firm*—Renner, Otto, Boisselle & Lyon

[57] ABSTRACT

A fluid servo actuator control/damping mechanism and method which utilize and combine the functions of an electro-mechanically driven servo valve to achieve ram or actuator fluid flow and load control even after loss of fluid power as well as the main ram position control function under normal operating conditions. The mechanism comprises a main control servo valve including a positionable valve element for selective application of fluid power to a ram, a sensor connectable to the ram for providing ram load feedback information, and an electro-mechanical drive operable independently of fluid power for selectively positioning the valve element under normal operating conditions for controlled actuation of the same and, upon loss of fluid power, for providing variable orifices to controllably meter bypass fluid flow across the ram by utilizing the existing return flow metering pattern of the servo valve and modulating the valve element thereof in response to feedback information received from the sensor, for actively controlled damping of the ram.

14 Claims, 1 Drawing Figure

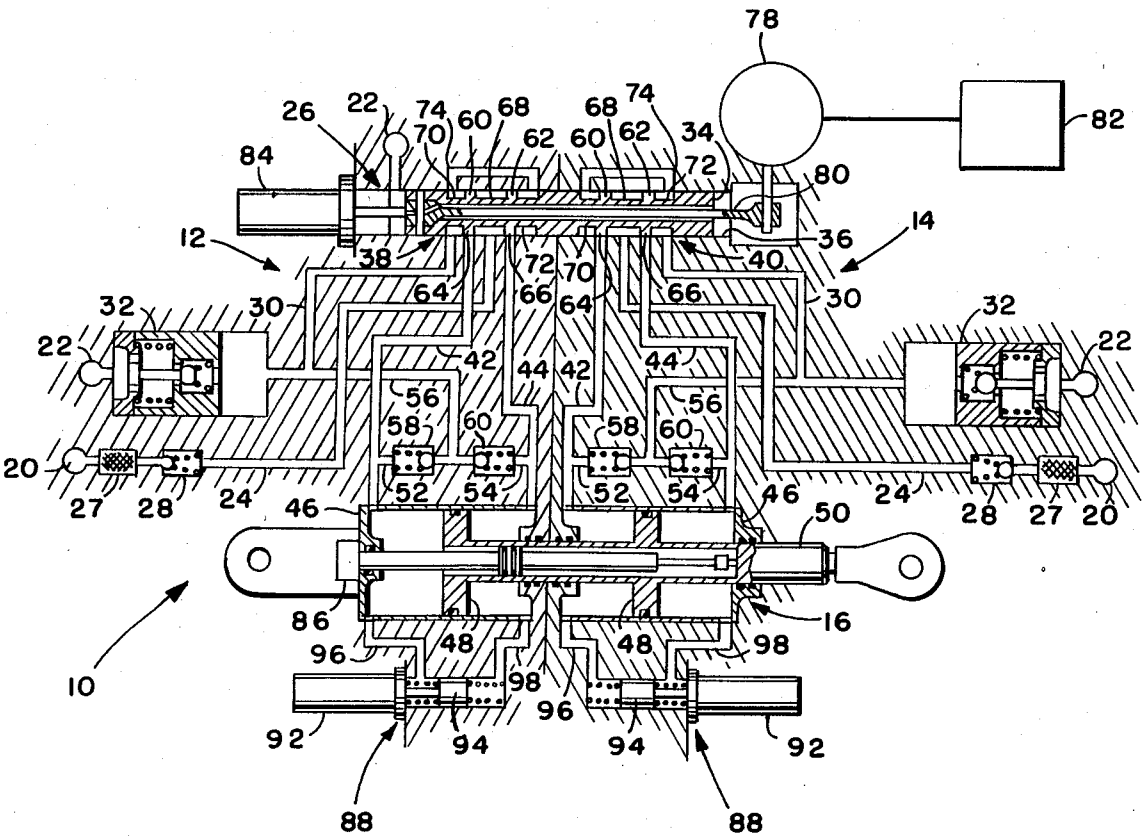
82
78
80
36
14
30
40
34
72
74
62
68
60
66
70
64
42
44
56
58
52
54
60
22
20
27
28
24
32
50
46
16
98
92
88
94
48
96
86
26
84
38
12
10

SERVO ACTUATOR CONTROL/DAMPING MECHANISM AND METHOD

This application is a continuation, of application Ser. No. 529,115, filed Sept. 2, 1983 now abandoned.

This invention relates generally to servo systems and, more particularly, to aircraft flight control servo systems. More specifically, the invention relates to a servo actuator control/damping mechanism and method which utilize and combine the functions of an electro-mechanically driven servo valve to achieve fluid flow and actuator (ram) load control even after loss of fluid power.

BACKGROUND

Fluid servo systems are used for many purposes, one being to position the flight control surfaces of high performance aircraft. In such an application, the servo system desirably should provide for control and damping of flight control surface displacements of flutter after loss of fluid power. Otherwise, aircraft damage or loss of control may result.

In conventional electro-hydraulic systems, electro-hydraulic valves have been used in conjunction with servo valve actuators to effect position control of the main control servo valve. Typically, the servo actuators in redundant systems operate on opposite ends of a linearly movable valve element in the main control valve and are controlled by the electro-hydraulic valves located elsewhere in the system housing. Such systems also have used bypass/damping valves which operate upon loss of fluid power to bypass flow to and from the main ram or actuator through fixed metering orifices which damp and control the rate of ram and flight surface movements. Like the electro-hydraulic valves, such bypass/damping valves have been located in the system housing remote from the main control valve. In addition, such systems have utilized electronic differential pressure sensors to provide dynamic ram load feed-back information to the aircraft electronic control system which supplies command signals to the electro-hydraulic valves.

An alternative approach to the electro-hydraulic control system is an electro-mechanical control system wherein a force motor is coupled directly and mechanically to the main control servo valve. For an example of one form of such systems, reference may be had to U.S. patent application Ser. No. 326,536, filed Dec. 2, 1981, now U.S. Pat. No. 4,466,597, granted Aug. 21, 1984 and entitled "Electro-Mechanical Direct Drive Valve Servo System with Rotary to Linear Valve Drive Mechanism". These systems also have used remotely located bypass/damping valves which bypass ram flow through fixed metering orifices upon loss of fluid power for damping and controlling the rate of ram and flight surface movements.

In hybrid electro-mechanical systems, the force motor is coupled directly and mechanically to a pilot valve plunger which controls a hydraulically powered servo valve actuator for driving the main control servo valve. As disclosed in U.S. patent application Ser. No. 442,873, filed on Nov. 19, 1982, now U.S. Pat. No. 4,472,988, granted Sept. 25, 1984, and entitled "Redundant Control Actuation System-Concentric Direct Drive Valve" and U.S. patent application Ser. No. 463,631, filed Feb. 3, 1983, now abandoned in favor of a continuation application Ser. No. 680,230, filed on Dec. 10, 1984, and both entitled "Control Actuation System Including Staged Direct Drive Valve With Fault Control", a shut-off valve sleeve concentric with the pilot valve plunger can be used to direct ram flow through fixed metering orifices upon loss of fluid power for damping and rate control of ram and flight surface movements.

As indicated, each of the foregoing systems uses added valves or valve components to achieve some degree of control over ram and flight surface movements after loss of fluid power. This results in increased package size especially in plural redundant systems where redundant valves or valve components are required for multiple hydraulic actuator systems. Furthermore, such valves or valve components are shuttled between system on and off (bypass) positions with the latter serving to direct actuator flow through the fixed metering orifices. Consequently, there has been no provision for active damping or flutter control in response to changing conditions at the ram or flight control surface. Also ram pressure relief flow through the fixed metering orifices may under some circumstances be insufficient to prevent overload of the ram and flight control surface and resultant damage.

With the foregoing in mind, it would be advantageous and desirable to provide for active and more precise load and damping control in an aircraft flight control servo system. Furthermore, it would be desirable to provide for such active or regulated control while minimizing system package size such as by attributing multiple functions to servo system components.

SUMMARY OF THE INVENTION

The present invention provides a fluid servo actuator control/damping mechanism and method which utilize and combine the functions of an electro-mechanically driven servo valve to achieve ram or actuator fluid flow and load control even after loss of fluid power as well as the main ram position control function under normal operating conditions. The mechanism is particularly useful in an aircraft flight control servo system wherein reduced package size and weight is desired along with active or regulated damping control and overload relief functions, and eliminates the need for separate bypass valves or valve components heretofore utilized to meter bypass ram flow through fixed orifices.

Briefly, the mechanism comprises a servo valve including a positionable valve element for selective application of fluid power to a ram, a sensor connectable to the ram for providing ram load feed-back information, and an electro-mechanical drive operable independently of fluid power for selectively positioning the valve element under normal operating conditions for controlled actuation of the ram and, upon loss of fluid power, for providing variable orifices to controllably meter bypass fluid flow across the ram by utilizing the existing return flow metering pattern of the servo valve and modulating the valve element thereof in response to feed-back information received from the sensor, for actively controlled damping of the ram.

Further stated, a servo mechanism according to the invention comprises a servo valve including a valve element selectively positionable therein to provide variable fluid pressure and return flow orifices for metering fluid flow to and from the opposed pressure surfaces of the ram, means for connecting a source of high pressure fluid to the servo valve for metered passage to either ram pressure surface through the variable fluid pressure orifices, means for directing bypass fluid flow from either pressure surface to the other through the variable return flow orifices in the event of a loss of such high pressure fluid, and electro-mechanical drive means operative independently of such high pressure fluid to controllably position the valve element to effect controlled metering of such high pressure fluid to either pressure surface of the ram for controlled actuation thereof and, in the event of a loss of such high pressure fluid, to effect controlled metering of bypass fluid flow across the ram for active or regulated damping and load control.

To the accomplishment of the foregoing and related ends, the invention, then, comprises the features hereinafter fully described and particularly pointed out in the claims, the following description and the annexed drawing setting forth in detail a certain illustrative embodiment of the invention, this being indicative, however, of but one of the various ways in which the principles of the invention may be employed.

BRIEF DESCRIPTION OF THE DRAWING

In the annexed drawing, the sole FIGURE thereof is a schematic illustration of a redundant servo system embodying a preferred form of servo actuator control/-damping mechanism according to the invention.

DETAILED DESCRIPTION

Referring now in detail to the drawing, a dual hydraulic servo system is designated generally by reference numeral 10 and includes two similar hydraulic servo actuators 12 and 14. The actuators 12 and 14 are connected to a common output device such as a dual tandem cylinder actuator or ram 16 which in turn may be connected to a control member such as a flight control element of an aircraft. It will be seen below that the two servo actuators normally are operated simultaneously to effect position control of the ram 16 and hence the flight control element. However, each servo actuator preferably is capable of properly effecting such position control independently of the other so that the control is maintained even when one of the servo actuators fails or is shut down. Accordingly, the two servo actuators in the overall system provide a redundancy feature that increases safe operation of the aircraft.

The servo actuators 12 and 14 are similar and for ease in description, like reference numerals will be used to identify corresponding like elements of the two servo actuators.

Each servo actuator 12, 14 has an inlet port 20 for connection with a source of high pressure hydraulic fluid and a return port 22 for connection with a hydraulic reservoir. Preferably, the respective inlet and return ports of the servo actuators are connected to separate and independent hydraulic systems in the aircraft, so that in the event one of the hydraulic systems fails or shuts down, the servo actuator coupled to the other still functioning hydraulic system may be operated to effect the position control function. Hereinafter, the hydraulic systems associated with the servo actuators 12 and 14 will respectively be referred to as the forward and aft hydraulic systems.

In each of the servo actuators 12 and 14, an inlet passage 24 connects the inlet port 20 to a common main control servo valve designated generally by reference numeral 26. Each inlet passage 24 may be provided with a suitable filter 27 and a check valve 28 which blocks reverse flow through the inlet passage from the servo valve to the inlet port. Each servo actuator also is provided with a return passage 30 which connects the return port 22 to the servo valve 26 via a damping mode accumulator or compensator 32 which serves to maintain pressure in the servo actuator sufficient to prevent cavitation across damping restrictions during damping mode operation as described hereafter.

The main control servo valve 26 includes a plunger or spool 34 longitudinally shiftable in a cylindrical bore 36 which may be formed by a sleeve (not shown) in an overall system housing. The plunger has two fluidically isolated valving sections indicated generally at 38 and 40, which valving sections are associated respectively with the actuators 12 and 14 and the passages 24 and 30 thereof. The plunger may be selectively shifted from its illustrated neutral or centered position for selective connection of the passages 24 and 30 of each servo actuator to passages 42 and 44 in the same servo actuator.

The passages 42 and 44 of both servo actuators 12 and 14 are connected to the ram 16 which includes a pair of cylinders 46 having respective pistons 48 connected to ram output rod 50 for common movement therewith. More specifically, the passages 42 and 44 of each servo actuator are connected to a corresponding one of the cylinders on opposite sides of the piston. The passages 42 and 44 also are connected by respective branch passages 52 and 54 to a common passage 56 which in turn is connected to the corresponding return passage 30. As shown, the branch passages 52 and 54 are respectively provided with anti cavitation check valves 58 and 60 which block fluid flow from the passages 42 and 44 to the common passage 56 but permit free flow from common passage 56 to passages 42 and 44.

With particular reference to the main control servo valve 26, each valving section 38, 40 of the plunger 34 has a pair of longitudinally (axially) spaced apart lands 60 and 62 which are locatable, as when the plunger is in its neutral position, to block flow through respective metering ports 64 and 66 that respectively connect the passages 42 and 44 to the interior of the plunger bore 36. The lands 60 and 62 define therebetween a supply groove 68 which is in communication with the inlet passage 24 and outwardly thereof respective return grooves 70 and 72 which are interconnected by passage 74 and in common communication with return passage 30. Accordingly, movement of the plunger to either side of its neutral position will connect the inlet passage 24 to one of the passages 42 and 44 and the other of such passages to return passage 30 through respective metering fluid pressure and return flow orifices defined by the position of the lands 60 and 62 relative to respective ports 64 and 66. Moreover, such metering fluid pressure and return flow orifices may be varied in size by selective positioning of the valve plunger in the manner hereinafter described for controlled metering of flow to and from the passages 42 and 44.

From the foregoing, it will be apparent that selective movement of the plunger 34 simultaneously controls both valving sections 38 and 40 which selectively connect one side of each piston 48 to a high pressure hydraulic fluid source and the other side to fluid return for controlled metering of flow to and from the ram 16 which in turn effects controlled movement of the output rod 50 either to the right or left. In the event one of the servo actuators 12, 14 fails or is shut down, the other servo actuator will maintain control responsive to selective movement of the plunger.

Controlled selective movement of the valve plunger 34 is desirably effected by an electric force motor 78 which may be located closely adjacent one end of the plunger. The force motor may be of linear or rotary type and operative connection of the force motor to the valve plunger may be obtained by a link member 80 such as in the manner described in the aforementioned U.S. application Ser. No. 463,631.

The force motor 78 is responsive to command signals received from an electronic control or command system indicated at 82 which may be located, for example, in the aircraft cockpit, whereby the force motor serves as a control input to the valve plunger 34. Also, the force motor preferably has redundant multiple parallel coils so that if one coil or its associated electronics should fail, its counterpart channel or channels will maintain control. Moreover, suitable failure monitoring circuitry is preferably provided to detect when and which channel has failed, and to uncouple or render passive the failed channel.

Feed-back information to the command system 82 is obtained by position transducers or sensors 84 and 86 which are desirably operatively connected to and monitor the positions of the valve plunger 34 and ram output rod 50, respectively. In addition, electronic load sensors 88 or equivalent devices are desirably operatively connected to respective cylinders 46 of the ram 16 for monitoring ram load and providing load feedback information to the command system 82 controlling the force motor 78. As shown, each load sensor 88 may be in the form of a differential pressure sensor including a position transducer 92 connected to a longitudinally shiftable spring centered piston 94. Opposite sides or pressure surfaces of the piston 94 are respectively connected by passages 96 and 98 to respective opposite sides or pressure surfaces of the piston 48 in the corresponding cylinder 46 of the ram whereby the position of the piston 94 and corresponding output of the transducer will be indicative of the direction and magnitude of differential pressure forces acting on the piston 48.

OPERATION

During normal operation of the servo system 10, high pressure fluid from the forward and aft hydraulic systems is supplied via respective inlet passages 24 to the main control servo valve 26. Through selective positioning of the valve plunger 34 in response to command signals received from the command system 82, high pressure fluid from each hydraulic system is controllably metered to either side of the respective piston 48 of the ram 16 to effect controlled movement of the ram output rod 50 with return flow from the opposite sides of the piston being simultaneously directed by the valve plunger to return via the passage 30. Further, each electronic load sensor 88 may be used during normal operation to provide dynamic load feed-back information to the command system 82 for implementation of damping and over-pressure relief functions in conventional manner, by modulating the position of the valve plunger 34 to vary the rate of fluid pressure and return flow to and from the opposite sides of the piston. Further, each electronic load sensor 88 may be used during normal operation to provide surface hinge movement control and hinge moment limiting by utilizing the dynamic load feed-back information to control the magnitude of the fluid pressure to the piston and thus amount of applied torque to the flight control surface. This would allow the servo to become a torque or force servo rather than a positional servo.

Should a loss of hydraulic power occur from both the forward and aft hydraulic systems, the command system 82 automatically implements damping mode operation. In the damping mode, the check valves 28 and compensators 32 serve to maintain positive pressure in the system 10 after such loss of hydraulic power by checking fluid loss through the inlet and return ports 20 and 22. The compensators' fluid storage volume can be selected such that damping may be met for a specified minimum period of time.

With positive pressure maintained in the system, active or regulated damping control of the ram 16 is effected by modulating the valve plunger 34 to provide variable return flow orifices which direct and meter bypass flow across each ram piston 48. In this regard, it is noted that the electromechanically driven servo valve 26 is not dependent on hydraulic power for valve plunger positioning whereby the valve plunger will continue to respond to system commands as long as at least one channel of the motor 78 and associated electronics survives and remains operative. Further, the valve plunger 34 is modulated in response to ram load feed-back information from the load sensors 88 which monitor the direction and amplitude of differential pressure across the pistons 48.

In an exemplary situation, over pressure existing or developed on the extend (left) side of each ram piston 48 may be bypassed across the ram to the retract (right) side of each piston by moving the valve plunger 34 to the right of its neutral position to provide a metering return flow orifice connecting passage 42 to return passage 30. This establishes correspondingly metered bypass flow across each piston, such flow passing through passage 42 and the provided return flow orifice at metering port 64 to return passage 30 which directs the flow of the retract side of the piston via bypass passage 56 and branch passage 54. Conversely, moving the valve plunger to the left of its neutral position will establish and meter bypass flow through the return flow orifice at metering port 66 in the opposite direction across each piston. Moreover, the provided return flow orifices at metering port 64,66 may be controllably varied in size to provide desired damped bypass flow by selective positioning of the valve plunger in response to command signals dictated by sensed ram conditions, i.e., ram position monitored by position sensors 86 and ram load monitored by load sensors 88.

Such active or regulated damping control in response to ram load feed-back further may have associated therewith an overload relief function in the damping mode. When excessive load on the ram 16 is sensed by the load sensors 88, an appropriate command signal may be provided to position the valve plunger 34 at a location providing a desired orifice size sufficient to effect rapid relief of such overload condition in order to prevent damage to the actuator and the controlled element connected thereto.

From the foregoing, it can be seen that bypass flow across the ram 16 may be controlled by utilizing the existing return flow metering pattern of the main control servo valve 26 and modulating the valve plunger 34 thereof to provide variable orifices for active damping and overload relief control. It also is noted that such active control is even more desirable in redundant systems as shown. If the ram 16 continues to be operated by high pressure fluid supplied to only one of the servo systems, the other servo system operates to effect by pass of the inactive portion of the ram 16. Therefore, the need in such instance for a separate bypass valve is eliminated by such implementation because the main control valve 26 is operated to permit fluid transfer across the respective piston 48 as in normal operation.

Although the invention has been shown and described with respect to a certain preferred embodiment, it is obvious that equivalent alterations and modifications will occur to others skilled in the art upon the reading and understanding of this specification. The present invention includes all such equivalent alterations and modifications, and is limited only by the scope of the following claims.

We claim:

1. A servo mechanism for use in a fluid servo system for controlling a fluid powered ram actuator having opposed pressure surfaces, comprising a servo valve including valve means selectively positionable therein to provide variable fluid pressure and return flow orifices for metering fluid flow to and return flow from the opposed pressure surfaces of the ram, means for connecting a source of high pressure fluid to said servo valve for metered passage to either pressure surface through said variable fluid pressure orifices, means for directing bypass fluid flow from either pressure surface of the ram to the other pressure surface through said variable return flow orifices in the event of a loss of such high pressure fluid, and electro-mechanical means operative independently of such high pressure fluid to controllably position said valve means to effect controlled metering of such high pressure fluid through said variable fluid pressure orifices to either pressure surface of the ram for controlled actuation thereof and, in the event of a loss of such high pressure fluid, to effect regulated metering of bypass flow through said variable return flow orifices and across the ram for active damping control thereof.

2. A servo mechanism as set forth in claim 1, wherein said electro-mechanical means includes an electric force motor directly mechanically connected to said valve means.

3. A servo mechanism as set forth in claim 1, further comprising sensor means for monitoring actuator load and providing actuator load feed-back information to said electro-mechanical means for implementing controlled modulation of said valve means in response to such actuator load feed-back information during both normal operation and when there is a loss of such high fluid pressure to provide dynamic load feedback damping and overpressure relief functions.

4. A servo mechanism as set forth in claim 3, wherein said sensor means includes means for monitoring the direction and amplitude of differential pressure acting on the opposed pressure surfaces of the ram.

5. A servo mechanism as set forth in claim 1, further comprising position sensor means connected to said valve means for providing valve means position feedback information to said electro-mechanical means during both normal operation and when there is a loss of such high fluid pressure.

6. A servo mechanism as set forth in claim 1, further comprising position sensor means connectable to said ram for providing ram position feedback information to said electro-mechanical means during both normal operation and when there is a loss of such high fluid pressure.

7. A servo mechanism as set forth in claim 1, wherein said servo valve has spaced ports respectively connectable to the opposed pressure surfaces of the ram, and said valve means includes a movable plunger having spaced lands thereon adapted to simultaneously block said ports, respectively, when in a neutral position and being movable out of said neutral position to provide for such metered flow through said variable fluid pressure and return flow orifices which are defined by the position of said spaced lands on said plunger to said spaced ports.

8. A servo system comprising a fluid powered ram actuator including a cylinder and a piston movable in said cylinder for extension and retraction of said ram, a servo valve including positionable valve means for selective connection of a source of high pressure fluid to either side of said piston and a return for such fluid from the other side of said piston through variable fluid pressure and return flow orifices in said servo valve which are varied by selectively positioning said valve means, thereby to effect extension and retraction of said ram, sensor means connected to said ram for providing ram load feedback information, and electro-mechanical means operable independently of such source of high pressure fluid for selectively positioning said valve means under normal operating conditions for controlled actuation of said ram and, upon loss of such source of high pressure fluid, for controllably metering bypass fluid flow across said piston through said variable return flow orifices in said servo valve by modulating said valve means in response to feedback information received from said sensor means, for actively controlled damping of said ram.

9. A servo system as set forth in claim 8, wherein said electro-mechanical means includes an electric force motor directly and mechanically connected to said valve means and electronic command means for receiving such feedback information and controlling said force motor.

10. A servo system as set forth in claim 8, wherein said ram includes a pair of cylinders and respective pistons interconnected for common movement, there is a separate source of high pressure fluid for each of said cylinders, and said valve means includes a pair of valving sections respectively associated with said pistons for redundant operation, each said valving section including respective variable fluid pressure and return flow orifices for providing metered fluid flow to and from opposite sides of the respective pistons in response to such selective positioning of said valve means under normal operating conditions, and upon loss of one such source of high pressure fluid for one of said cylinders, said electro-mechanical means is still operable independently of such other source of high pressure fluid to selectively position said valve means for controlled actuation of said ram utilizing such other source of high pressure fluid acting on one of said pistons, and for controlled metering of bypass fluid across the other piston associated with the lost source of high pressure fluid through said variable return flow orifices in the respective valving section of active controlled damping of said other piston.

11. A method of controlling a servo system including a fluid powered ram actuator having opposed pressure surfaces, a main control servo valve having valve means positionable therein to provide variable fluid pressure and return flow orifices for metering flow to and from the opposed pressure surfaces of the ram, and electro-mechanical means operative independently of fluid power to effect selective positioning of the valve means, said method comprising (a) operating the system in a normal operational mode by (i) connecting a source of high pressure fluid to the servo valve, and (ii) utilizing the electro-mechanical means to selectively position the valve means for metered passage of such high pressure fluid to either pressure surface of the ram through the variable fluid pressure orifices and from the opposed pressure surface of the ram through the variable return flow orifices, for controlled actuation of the ram; and (b) operating the system in a damping operational mode upon loss of such source of high pressure fluid by (i) directing bypass fluid flow from either pressure surface of the ram to the other pressure surface through the same variable return flow orifices that are used in such normal operational mode, and (ii) utilizing the electro-mechanical means to selectively modulate the valve means for regulated metering of such bypass fluid flow through such variable return flow orifices and across the ram for active damping control thereof.

12. A method as set forth in claim 11, comprising the step of sensing ram load and modulating the valve means in response to sensed load in the damping operational mode.

13. A method as set forth in claim 2, comprising the step of using a force motor to directly and mechanically effect such positioning and modulating of the valve means.

14. A method as set forth in claim 11, wherein the ram includes a pair of cylinders and respective pistons interconnected for common movement, there is a separate source of high pressure fluid for each of such cylinders, and the valve means includes a pair of valving sections respectively associated with the pistons for redundant operation, each such valving section including respective variable fluid pressure and return flow orifices for providing metered fluid flow to and from opposite sides of the respective pistons in response to such selective positioning of such valve means under normal operating conditions, further comprising the step of operating the electro-mechanical means independently of either such source of high pressure fluid to selectively position the valve means for controlled actuation of the ram utilizing either source of high pressure fluid acting on the respective piston when the other source of high fluid pressure is lost, and for controlled metering of bypass fluid across the other piston associated with the lost source of high pressure fluid through the variable return flow orifices in the respective valving section for actively controlling damping of such other piston.

* * * * *